US005221557A

United States Patent [19]

Hunter et al.

[11] Patent Number: 5,221,557

[45] Date of Patent: Jun. 22, 1993

[54] V-GROOVABLE GRAVURE PRINTABLE PAPER

[75] Inventors: Bruce M. Hunter, Pennsburg; Harold C. Hieter, Quakertown, both of Pa.

[73] Assignee: W.R. Grace & Co.-Conn., New York, N.Y.

[21] Appl. No.: 810,949

[22] Filed: Dec. 19, 1991

[51] Int. Cl.[5] ..... B05D 3/12

[52] U.S. Cl. ..... 427/366; 427/365; 427/391

[58] Field of Search ..... 427/361, 365, 366, 391

[56] References Cited

U.S. PATENT DOCUMENTS

| | | | |
|---|---|---|---|
| 2,790,736 | 4/1957 | McLaughlin et al. | 427/361 |
| 2,874,066 | 2/1959 | McLaughlin et al. | 427/361 |
| 2,943,952 | 7/1960 | Clark | 117/36 |
| 2,975,147 | 3/1961 | Abbott et al. | 260/7.5 |
| 3,014,004 | 12/1961 | Meier | 260/29.6 |
| 3,037,952 | 6/1962 | Jordan et al. | 260/29.6 |
| 3,066,109 | 11/1962 | Hechtman et al. | 260/29.6 |
| 3,068,118 | 12/1962 | Biskup et al. | 117/76 |
| 3,206,427 | 9/1965 | Butzler et al. | 260/31.8 |
| 3,257,234 | 6/1966 | Gilman et al. | 427/361 |
| 3,303,046 | 2/1967 | Chebiniak et al. | 117/36.1 |
| 3,455,726 | 7/1969 | Mitchell et al. | 117/76 |
| 4,010,307 | 3/1977 | Canard et al. | 428/327 |
| 4,069,186 | 1/1978 | Ramig | 260/29.6 |
| 4,081,583 | 3/1978 | Akiyama et al. | 428/457 |
| 4,115,331 | 9/1978 | Tominaga et al. | 260/17.4 |
| 4,247,438 | 1/1981 | Eck et al. | 260/29.6 |
| 4,271,221 | 6/1981 | Hosmer | 427/372.2 |
| 4,277,385 | 7/1981 | Carroll et al. | 260/29.6 |
| 4,302,367 | 11/1981 | Cordes et al. | 260/17 R |
| 4,384,069 | 5/1983 | Wendel et al. | 524/521 |
| 4,408,015 | 10/1983 | Flatau | 525/227 |
| 4,543,387 | 9/1985 | Padget et al. | 524/523 |
| 4,619,960 | 10/1986 | Dodge | 524/245 |

OTHER PUBLICATIONS

*Plastic Films*, Second Edition by J. H. Briston, 1983 (pp. 78–81).

*Primary Examiner*—Anthony McFarlane

*Attorney, Agent, or Firm*—Craig K. Leon; William L. Baker

[57] ABSTRACT

V-groovable gravure printable paper having the machinability of vinyl and the printability of paper, and a process for manufacturing such a product. A smooth, saturated only paper is subjected to heavy calendering during processing in order to provide adequate smoothness as required by printers. The paper is saturated with an acrylic/PVC blend designed to give good "miter-fold" strength, good smoothness and adequate adhesive anchorage. The saturant also allows the ink types used on vinyl films to adhere to the paper, and exhibits good stain resistance.

18 Claims, 2 Drawing Sheets

V-GROOVABLE GRAVURE PRINTABLE PAPER

BACKGROUND OF THE INVENTION

Decorative vinyl laminates have become a recognized alternative to natural woods in furniture manufacture and woodworking in general, due to their abrasion resistance, scratch resistance, water resistance, chemical resistance, barrier performance and flame spread resistance. In addition, adhesive technology has advanced to the extent that various epoxy, emulsion and solvent adhesives are available to bond the laminates to the substrate, depending upon the desired application. However, notwithstanding its adequate physical properties, vinyl has high elongation, resulting in a poor printed appearance compared to that of paper. Indeed, a typical vinyl product is 2 plys, a solid color base (color throughout) that is printed and a clear vinyl that is laminated over the print so as to protect if from abuse. The clear film is often coated with a scratch resistant coating to enhance its protective properties. Vinyl's poor appearance when printed stems from its high elongation; it stretches when in the printing press thereby "smearing" the image. Where paper is used instead, a pigmented paper can be used to eliminate the over-print step, resulting in superior print quality. Paper also handles better in lamination than does vinyl. Accordingly, it is desirable to use paper instead of vinyl. However, paper has lacked the physical strength necessary to perform as a machinable material. In particular, in miter-fold particle board applications, the paper must have sufficient strength to resist tearing and/or splitting when the miter-fold edge is formed. Heretofore, the superior printing quality of paper could not be exploited in such applications because of the severe stresses encountered during the miter-folding or "V-grooving" of the board.

SUMMARY OF THE INVENTION

The problems of the prior art have been overcome by the present invention, which provides a product that has the machinability of vinyl and the printability of paper, and a process for manufacturing such a product. Specifically, the product of the instant invention is a smooth, saturated only paper that is subjected to heavy calendering during processing in order to provide adequate smoothness as required by printers. The paper is saturated with an acrylic/PVC blend designed to give good "miter-fold" strength, good smoothness and adequate adhesive anchorage.

The particular saturant system used also allows the ink types used on vinyl films to adhere to the paper, and exhibits good stain resistance.

DETAILED DESCRIPTION OF THE INVENTION

Figure 1:
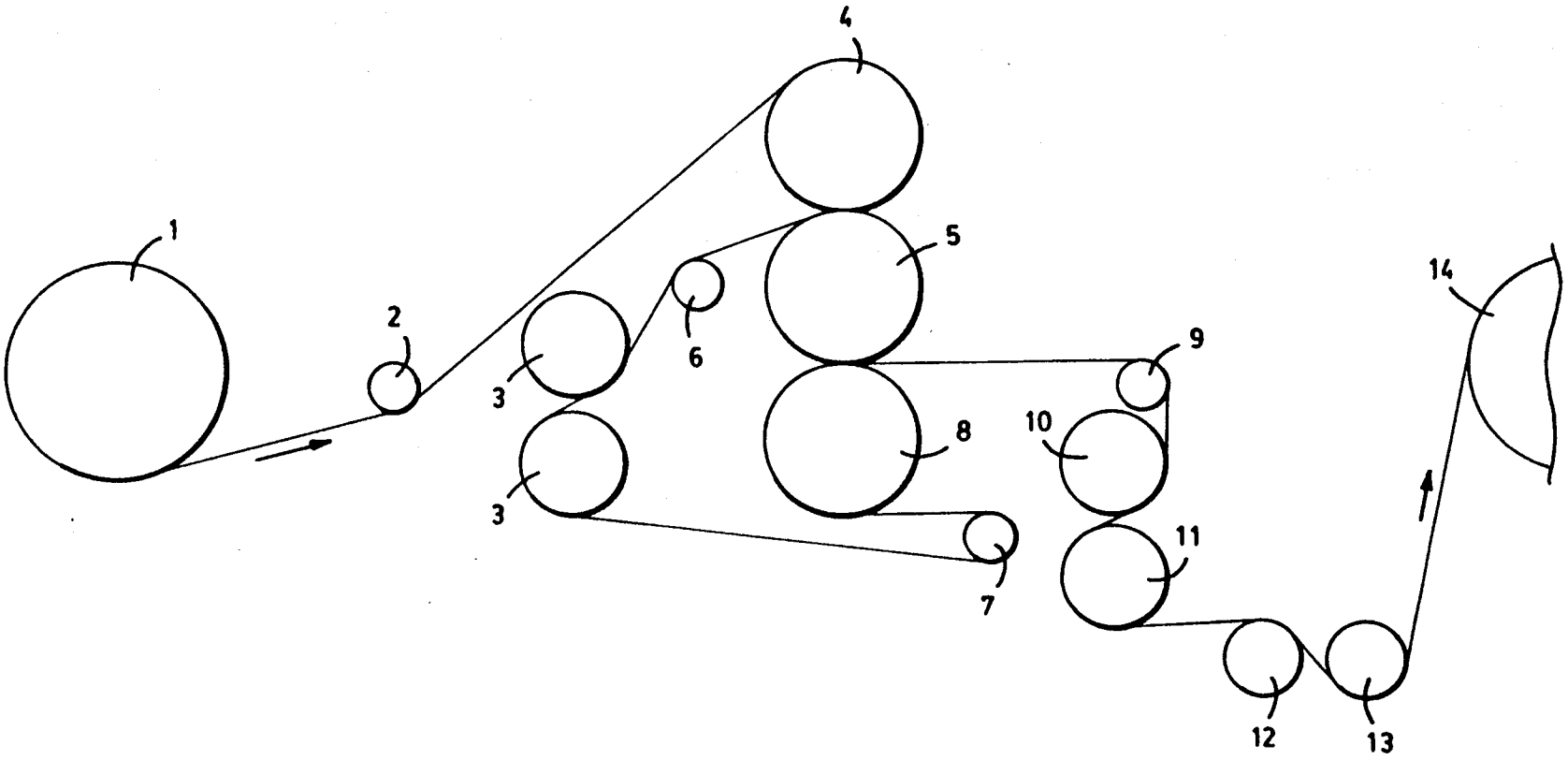
FIG. 1 is a diagrammatic view of the threading system for the stack calender used in accordance with the present invention.

Suitable raw paper for use in the instant invention must be selected based upon good formation and good property potential, and must be saturable. The preferred raw paper meeting these requirements is Owensboro HP-8 75# available from W. R. Grace & Co. Conn.

Such paper has a fiber composition of 85% (by weight) Northern Bleached Softwood Kraft and 15% (by weight) Hemlock Sulfite.

The saturant system must be able to withstand the actual physical abuse delivered to the sheet during the V-grooving operation. The physical properties that relate best to this operation are, in the order of importance, edge tear or tear initiation, internal tear (tear propagation), delamination resistance, and tensile strength/elongation. In addition, the saturant system must have the ability to be calendered to a high degree of smoothness, and must maintain that smoothness. An immediate smoothness less than about 100 Sheffield units is preferred. An acrylic system, being plastic in nature, has been found to calender to the required smoothness. Acrylics are also lightfast, which is a further advantage of the saturant. Preferably the major ingredient of the instant saturant is an acrylic latex, such as HYCAR 26104 available from The B. F. Goodrich Chemical Company. The acrylic latex can be used in an amount of from 55% to 96.75%, preferably 55–66%, most preferably about 56.75%, on a dry basis, depending upon the processing and smoothness retention. For maintaining smoothness, inorganic fillers in the saturant system such as clay or titanium dioxide tend to cause failures during miter-folding. Organic fillers such as unplasticized polyvinyl chloride, being less destructive to the cellulose fibers during folding because the particles are spherical as opposed to the platelet structure of the inorganics mentioned, are suitable. Preferably the filler is a polyvinyl chloride latex such as GEON 352 available from The B. F. Goodrich Chemical Company, used in an amount of from 0% to 40%, preferably 33–40%, most preferably about 40%, on a dry basis.

In order to increase the delamination resistance of the product, it is necessary to reduce the level of binder migration common during the drying of heavyweight papers. A thickener in the saturant system can be added for this purpose. Virtually any cellulosic thickener can be used, as can sodium polyacrylate and alkali reactive emulsions. However, cellulosics impart solvent resistance to the saturant (which can interfere with the printability), and brittleness. Sodium polyacrylate and the alkali reactive emulsions also exhibit these effects and can be water sensitive as well. Accordingly, the preferred thickener is sodium alginate. Kelgin MV, available from Kelco, Inc. has been found to be suitable, and is used in an amount of from 0.15% to 0.35%, dry basis, to limit migration at various saturator line speeds.

Another functional ingredient for the saturant system is a release agent, designed to migrate to the surface of the sheet during the calendering operation and provide release from the hot steel rolls. Emulsified waxes or waxy materials could be used for this purpose, although emulsified waxes tend to cause smoke generation during processing. Waxy materials such as stearylated melamine can impart other properties that may or may not be undesirable, such as water resistance after processing. Preferably the release agent is sorbitan tristearate, such as TWEEN 65, available from ICI Americas, Inc. The sorbitan tristearate has also been found to "fill" the sheet surface, thereby contributing to the smoothness. It is used in an amount of from 0% to 3%, dry basis, to provide release from the very hot calender rolls at various calender line speeds.

Other inert ingredients, such as pigments and defoamers can be added. Preferably the paper is saturated to a 40% add-on level.

Preferably the ingredients of the saturant system are used in the following amounts on a dry solids basis:

56.75% acrylic latex
40.00% polyvinyl chloride latex
0.25% sodium alginate
3.00% sorbitan tristearate Since the pH of acrylic latexes is generally low, and the pH of PVC latexes is generally high, it is preferred that the pH of the acrylic latex be raised with dilute ammonium hydroxide and that the PVC latex be added thereto slowly. The order of addition of the remaining ingredients is not critical.

FIG. 1 illustrates the lacing procedure used to calender the saturated paper in accordance with the instant invention. The paper is unwound from roll 1, and passes by tension transducer roll 2 to heated steel calender roll 4. The paper then travels through a nip formed between roll 4 and fiber calender roll 5, past mt. hope spreader roll 6, tension rolls 3 and 3' (turned off and used as idler rolls), idler roll 7, and a second heated steel calender roll 8 where it is again heated. A second nip is formed between the second heated calendar roll 8 and fiber calendar roll 5. The sheet then passes over a steel idler roll 9, and is cooled by first and second cooling rolls 10 and 11. Adequate heat transfer between the paper web and these cooling rolls can be accomplished by cooling the rolls with ordinary tap water, which is typically at temperatures from 58° F. to 72° F., most typically 65° F. The sheet then passes over a large diameter mt. hope roll 12 and a large diameter idler roll 13, and is rewound on roll 14. The practical minimum diameter of any of the rolls is about 3 inches. The saturator squeeze rolls (not shown) and the calender steel rolls must be of a diameter and construction that will resist flexing during operation. As a practical matter, the minimum diameter of any of the rolls is 3 inches.

Temperature of the heated calender rolls, line speed and nip pressure are critical in order to achieve uniform caliper and smoothness of the sheet. Line speed and nip pressure have been found to effect the immediate Sheffield smoothness; higher speeds and higher pressures equate to lower immediate Sheffield smoothness. Line speed alone effects the Sheffield smoothness after 24 hours; lower line speeds produced material that had higher 24 hour Sheffield smoothness values. Temperature and pressure have a significant effect on the percent increase in smoothness after 24 hours, whereas line speed has only a slight effect. Higher temperature, higher pressure and lower line speeds lead to larger percent increases in smoothness after 24 hours. None of the variables were found to effect the machine direction (MD) or cross direction (CD) miter fold, or the CD internal tear. Line speed was found to effect MD internal tear; higher line speeds produced lower MD internal tear values. Higher line speeds also led to higher burst values. Based upon the foregoing, it is preferred that the line speed be 150 feet/minute, that the nip pressure be 1100 psig, and that the temperature of the heated steel calendar rolls 4 and 8 be 325° F. Significant deviations from these values result in a product that is unstable in terms of smoothness.

EXAMPLE 1

Figure 2:
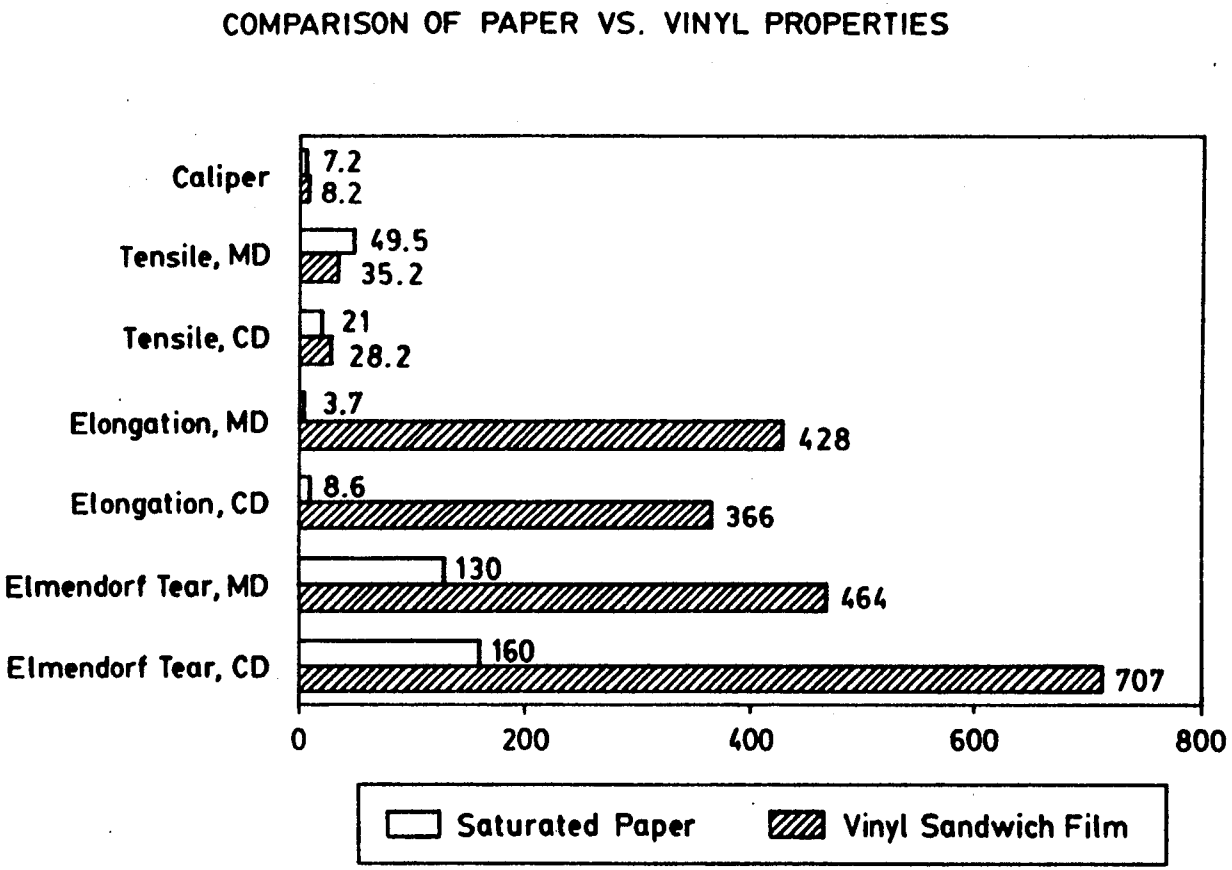
FIG. 2 is a comparison of important properties of paper and vinyl for particle board overlay applications.

A comparison of some of the properties of paper and 8 mil vinyl sandwich film is shown in FIG. 2. The vinyl sandwich film compared therein was produced in accordance with the process outlines in *PLASTIC FILMS*, second edition, by John H. Briston, chapter 8, section 2, 1983, the disclosure of which is hereby incorporated by reference: In particular, the sandwich film is two films, one colored and printed and the other clear, that are laminated together. Both of the films of this sandwich were made by the process outlined in section 8.2.

The saturated paper of FIG. 2 was made in accordance with the instant invention. The untreated paper was saturated by forcing the paper to enter a large shallow pan that contained the saturant mixture. The paper was then directed through a pair of squeeze rolls similar to wringer rolls on old-style washing machines. This squeezing or wringing of the paper controls the add-on level. After squeezing, the paper was dried by a combination of forced hot-air, infrared and contact heat dryers. The paper was saturated to a 40% add-on level. Once dry, the paper was rerolled and subjected to the calendering process in accordance with the instant invention.

FIG. 2 shows the significant advantages realized when using paper instead of vinyl in terms of percent elongation and Elmendorf Tear (grams), without sacrificing tensile strength (lbs/inch of width). Preferably the saturated paper used in accordance with the instant invention has a caliper of 6–8 mils and a Sheffield smoothness of about 85.

What is claimed is:

1. A process for saturating paper, comprising the steps of providing paper, applying a saturant to said paper, said saturant comprising acrylic latex, polyvinyl chloride latex, sodium alginate and sorbitan tristearate, and calendering said paper to a caliper thickness of 6–8 mils and a Sheffield smoothness of less than 100.

2. The process of claim 1 wherein in said saturant said acrylic latex is present in an amount of 55.0–96.75%, said polyvinyl chloride latex is present in an amount of 33–40%, said sodium alginate is present in an amount of 0.15–0.35%, and said sorbitan tristearate is present in an amount of 0–3%, all on a dry solids basis.

3. The process of claim 1 wherein said paper is saturated to a 40% add-on level.

4. The process of claim 1 wherein in said saturant said acrylic latex is present in an amount of 55.0–96.75%, said polyvinyl chloride latex is present in an amount of 33–40%, said sodium alginate is present in an amount of 0.15–0.35%, and said sorbitan tristearate is present in an amount of 0–3%, all on a dry solids basis.

5. A V-groovable paper made according to the process of claim 4.

6. The paper of claim 5 wherein in said saturant said acrylic latex is present in an amount of 55.0–96.75%, said polyvinyl chloride latex is present in an amount of 33–40%, said sodium alginate is present in an amount of 0.15–0.35%, and said sorbitan tristearate is present in an amount of 0–3%, all on a dry solids basis.

7. A process for saturating paper, comprising the steps of providing paper, applying a saturant to said paper, said saturant comprising acrylic latex, polyvinyl chloride latex, sodium alginate and sorbitan tristearate, calendering said saturated paper by threading said paper through a stack calender at a line speed of 150 feet per minute, said calendering being accomplished at a temperature of 325° F. and at a nip pressure of 1100 psig.

8. The process of claim 7 wherein said paper is saturated to a 40% add-on level.

9. The process of claim 7 wherein said paper is threaded through said calender stack comprising a first calender roll, a second calender roll positioned so as to form a first nip with said first calender roll, and a third calender roll positioned to form a nip with said second calender roll.

10. The process of claim 9 wherein said first calender roll is heated.

11. The process of claim 10 wherein said first calender roll is heated to 325° F.

12. The process of claim 9 wherein said third calender roll is heated.

13. The process of claim 12 wherein said third calender roll is heated to 325° F.

14. The process of claim 7 wherein after passing through said calender stack, said saturated paper is passed over the surface of a cooling roll.

15. A process for saturating paper, comprising the steps of providing paper, applying a saturant to said paper, said saturant comprising acrylic latex, polyvinyl chloride latex, sodium alginate and sorbitan tristearate; and calendering said saturated paper.

16. A V-groovable paper made according to claim 15.

17. The paper of claim 16 wherein said paper has been calendered to a Sheffield smoothness of less than 100.

18. The paper of claim 16 wherein said paper has been calendered to a caliper thickness of 6–8 mils.

* * * * *